US005217544A

United States Patent [19]

Baltenneck et al.

[11] Patent Number: 5,217,544

[45] Date of Patent: Jun. 8, 1993

[54] PROCESS FOR THE PRODUCTION OF A STAINLESS STEEL WITH MARTENSITE FERRITE TWO-PHASE STRUCTURE AND STEEL OBTAINED BY THE PROCESS

[75] Inventors: Serge Baltenneck, Fosses; Jean-Claude Charenton, Ugine, both of France

[73] Assignee: Ugine S.A., Puteaux, France

[21] Appl. No.: 813,010

[22] Filed: Dec. 24, 1991

[30] Foreign Application Priority Data

Dec. 27, 1990 [FR] France ..... 90 16352

[51] Int. Cl.[5] ..... C22C 38/40; C21D 8/00

[52] U.S. Cl. ..... 148/325; 148/610; 148/505

[58] Field of Search ..... 148/325, 505, 610

[56] References Cited

U.S. PATENT DOCUMENTS 4,824,491 4/1989 Tanaka et al. ..... 148/610

FOREIGN PATENT DOCUMENTS 0273279 7/1988 European Pat. Off. .
2923532 7/1980 Fed. Rep. of Germany .
3105891 9/1982 Fed. Rep. of Germany .
1555907 12/1968 France .

OTHER PUBLICATIONS

Mecanique, No. 289, Jan. 1974, Paris, pp. 35-39, P. Rousseau, "Aciers Inoxydables a Hautes Caracteristiques".

*Primary Examiner*—Deborah Yee
*Attorney, Agent, or Firm*—Oblon, Spivak, McClelland, Maier & Neustadt

[57] ABSTRACT

The present invention relates to a process for the production of a stainless steel with a high elastic limit and a high breaking load, with a martensite ferrite two-phase structure exhibiting good malleability and good abrasion resistance, in which the steel of the following weight composition:

carbon lower than 0.10%
chromium between 16 and 20%
nickel between 0.2 and 2%
manganese lower than 2%
copper lower than 2% the remainder being iron and impurities which are inherent in the method of production, is subjected to a quenching after being raised to a temperature of between 800° to 1200° C., and at least one cold rolling to a content of more than 15%.

The present invention also relates to a stainless steel obtained by this process.

11 Claims, 2 Drawing Sheets

PROCESS FOR THE PRODUCTION OF A STAINLESS STEEL WITH MARTENSITE FERRITE TWO-PHASE STRUCTURE AND STEEL OBTAINED BY THE PROCESS

The present invention relates to a process for the production of a stainless steel with a high elastic limit and a high breaking load, with a martensite ferrite two-phase structure, exhibiting good malleability and a high abrasion resistance.

The present invention also relates to a stainless steel with martensite ferrite two-phase structure, obtained by this process, and to a conveyor chain made of such a stainless steel.

EP-A-0,273,278 and EP-A-0,273,279 disclose a stainless steel with a martensite ferrite two-phase structure, whose weight composition is as follows:

carbon lower than 0.1%
chromium between 10 and 20%
nitrogen lower than 0.12%
carbon+nitrogen between 0.01 and 0.2%
silicon lower than 2%
manganese lower than 4%
nickel lower than 4%
copper lower than 4%
Ni+(Mn+Cu)/3 between 0.5 and 5%,
the remainder being iron.

The steel is subjected to an annealing treatment while moving, in a furnace, to obtain a ferrite-austenite structure. This steel is then quenched to obtain martensite from the austenite.

Such a process makes it possible to obtain high breaking loads, but does not meet the requirement of a high elastic limit. For example, in the case of given breaking loads of 800 to 950 MPa, the elastic limit varies from 415 to 635 MPa, that is in a ratio of 50 to 70% of the breaking load.

From DE-A-2,923,532 there is also known a ferritic stainless steel for conveyor chains, obtained from the following weight composition:

carbon between 0.03 and 0.06%
silicon lower than 1%
manganese lower than 1%
chromium between 16 and 17.5%
nickel between 0.8 and 1%,
the remainder being iron.

After annealing, the stainless steel is rolled to a ratio of between 18 and 25% in order to obtain the following mechanical characteristics:

breaking load between 750 and 800 MPa
elastic limit higher than 600 MPa
elongation higher than 10%.

Such a steel exhibits an elastic limit corresponding to approximately 75% of the breaking load, but the mechanical characteristics obtained are too low for an envisaged application such as, for example, the manufacture of conveyor chains.

The objective of the present invention is to obtain a stainless steel with a high elastic limit and high breaking load and additionally exhibiting good characteristics with regard to slitting, cutting, malleability and resistance to corrosion and to abrasion.

The subject of the present invention is therefore a process for the production of a stainless steel with a martensite ferrite two-phase structure, characterised in that the steel of the following weight composition:

carbon lower than 0.10%
chromium between 16 and 20%
nickel between 0.2 and 2%
manganese lower than 2%
copper lower than 2%
the remainder being iron and impurities which are inherent in the method of production, and in which the various contents correspond to the relationship:

$$20\%\ C+1.1\%\ Ni+\tfrac{1}{3}\%\ (Mn+Cu)=1.5 \text{ to } 2.5$$

is subjected successively to:

a quenching after being raised to a temperature of between 800° to 1200° C., and
at least one cold rolling to a ratio high than 15%.

According to other characteristics:

the carbon content is lower than 0.05%,
the stainless steel additionally optionally contains less than 2.5% of molybdenum in its weight composition,
the steel is subjected to a quenching after a temperature rise of between 900° and 1100° C.

The present invention also relates to a stainless steel with a martensite ferrite two-phase structure in which the ferritic or martensitic phases are in a proportion of between 40 and 60% and preferably in a proportion of approximately 50%.

Such a steel exhibits a breaking load higher than 950 MPa and an elastic limit higher than 900 MPa, the elastic limit being higher than or equal to 90% of the breaking load.

A particular subject of the present invention is a conveyor chain made of such a stainless steel.

The characteristics and advantages will appear in the course of the description which is to follow, given solely by way of example, made with reference to the attached drawings which show the curves of breaking load (Rm), elastic limit (Rp 0.2) and elongation (E %) as a function of the cold rolling ratio.

EXAMPLE 1

In an example of production according to the invention, two so-called 17% chromium stainless steels were produced, whose compositions are as follows:

Steel A: C=0.02%, Cr=16.5%, Ni=1.4% Mn=0.40%, Cu=0.05%,
Steel B: C=0.04%, Cr=16.5%, Ni=1.4% Mn=0.35%, Cu=0.05%,
the remainder being iron and impurities inherent in the method of production.

The defined contents correspond to the relationship:

$$20\%\ C+1.1\%\ Ni+\tfrac{1}{3}\%\ (Mn+Cu)=1.5 \text{ to } 2.5,$$

the algebraical sum of the compositions being equal to 2.1 in the case of steel A and 2.5 in the case of steel B.

According to the invention, a ferritic-martensitic structure was obtained by subjecting the steels of compositions defined above to a quenching after a rise in the temperature of the said steels between 900° and 1100° C. for a few minutes.

Martensite-rich steels are conventionally little employed or not employed because of their brittleness and the risks of breakage which they entail in rolling operations and when pieces are shaped.

Unexpectedly, no incident appeared during the cold rolling of these ferritic-martensitic two-phase steels by rolling.

Figure 1:
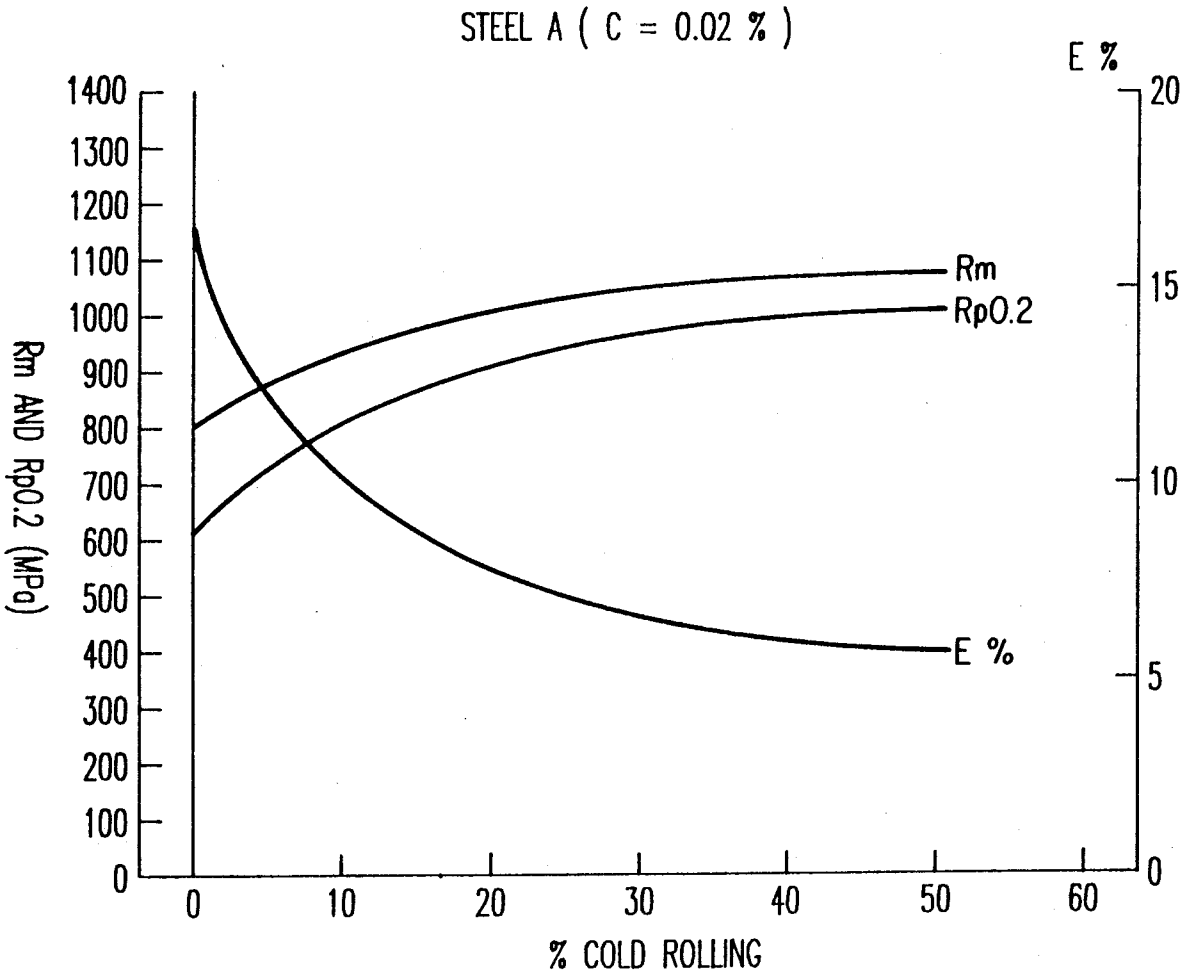
FIG. 1 shows the breaking load (Rm), elastic limit (Rp 0.2) and elongation (E %) as a function of cold rolling ratio for Steel A in Example 1.
Figure 2:
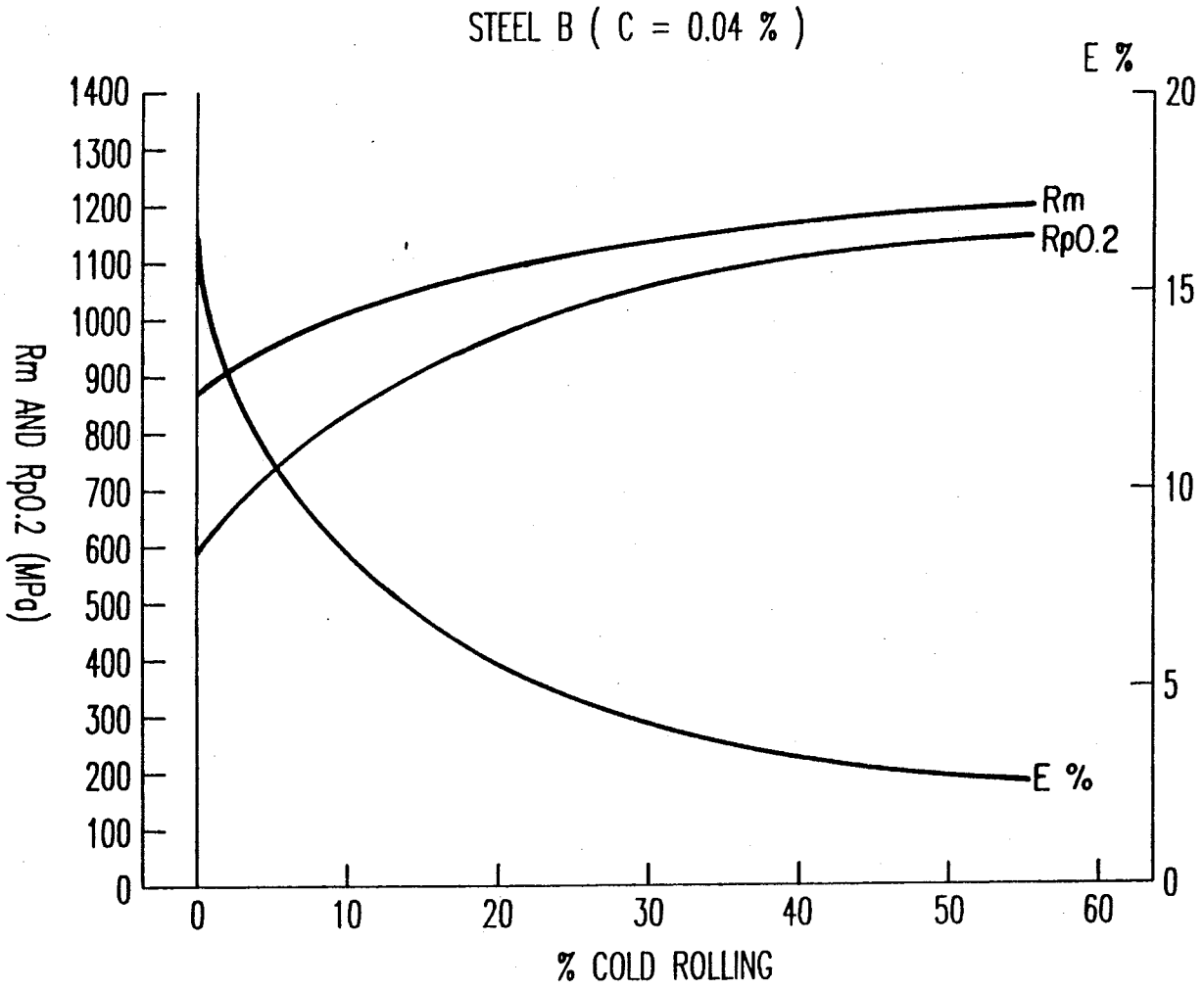
FIG. 2 shows the curve of breaking load (Rm), elastic limit (Rp 0.2) and elongation (E %) as a function of cold rolling ratio for Steel B in Example 1.

After production and thermal and mechanical treatments the steels exhibit, as shown in FIGS. 1 and 2, on the one hand a breaking load of 1070 MPa, an elastic limit which is substantially equal to 1050 MPa, an elongation of 6% with a cold rolling of 40% of steel A and, on the other hand, a breaking load of 1180 MPa, an elastic limit equal to approximately 1140 MPa and an elongation of 3.5% in the case of a cold rolling of 40% of steel B.

In addition, the improvement in the abrasion resistance ensured by an increase in the mechanical characteristics by cold rolling: breaking load, elastic limit, etc., is reinforced by the presence of a martensitic phase in a ferritic structure forming the two-phase steel.

After the obtaining of the two-phase and cold-rolled steel sheet, shaping operations made it possible to produce a conveyor chain component, the shaping comprising slitting, cutting and rolling operations.

It has been found that steels A and B according to the invention, produced in sheet form, despite a percentage of 50% and 55% of martensite respectively and despite a cold rolling greater than 40% exhibit an excellent suitability for the production of components such as, for example, conveyor chain links.

The tensile behaviour of the conveyor chain component, when compared with existing conveyor chains made of cold-rolled steel of the 430 type, is 40% higher. It is also found that the corrosion resistance is improved with the steel according to the invention.

An excessively high carbon content causes a sensitisation to intergranular corrosion. The carbon contents chosen in the composition of the steels and the process according to the invention greatly reduce the precipitation of chromium carbides, at the source of the sensitisation of stainless steels to intergranular corrosion, but also to corrosion in a chloride-containing aqueous medium.

The introduction of less than 2.5% of molybdenum into the steel composition increases the corrosion resistance and more particularly the resistance to corrosion in a chloride-containing aqueous medium.

The process according to the invention can be employed with products of various shapes, sheets, bars, tubes, wires etc.

We claim:

1. A process for the production of a stainless steel with a high elastic limit and a high breaking load, with a martensite ferrite two-phase structure, exhibiting good malleability and a high abrasion resistance, comprising subjecting a steel of the following weight composition:

carbon lower than 0.05%
chromium between 16 and 20%
nickel between 0.2 and 2%
manganese lower than 2%
copper lower than 2% the remainder being iron and impurities which are inherent in the method of production, and in which the various contents correspond to the relationship $$20\%\ C + 1.1\%\ Ni + \tfrac{1}{3}\%\ (Mn+Cu) = 1.5 \text{ to } 2.5$$

successively to:

a quenching after being raised to a temperature of between 800° and 1200° C., and at least one cold rolling to a ratio higher than 15%.

2. A process according to claim 1, characterised in that the carbon content is lower than 0.05%.

3. A process according to claim 1, characterised in that the steel additionally contains less than 2.5% of molybdenum in its weight composition.

4. A process according to claim 1, characterised in that the steel is subjected to a quenching after a temperature rise of between 900° and 1100° C.

5. A stainless steel having a martensite ferrite two-phase structure obtained by the process according to any one of claims 1 to 4.

6. A steel according to claim 5, wherein the ferritic or martensitic phases are present in a proportion of between 40 and 60%.

7. A steel according to claim 5, wherein the ferritic or martensitic phases are present in a proportion of approximately 50%.

8. A steel according to claim 5, which exhibits a breaking load higher than 900 MPa.

9. A steel according to claim 5, which exhibits an elastic limit higher than 800 MPa, the elastic limit being higher than or equal to 90% of the breaking load.

10. A conveyor chain comprising the martensite ferrite two-phase steel according to claim 5.

11. A process for the production of a stainless steel with a high elastic limit and a high breaking load, with a martensite ferrite two-phase structure, exhibiting good malleability and a high abrasion resistance, consisting of subjecting a steel of the following weight composition:

carbon lower than 0.05%
chromium between 16 and 20%
nickel between 0.2 and 2%
manganese lower than 2%
copper lower than 2% the remainder being iron and impurities which are inherent in the method of production, and in which the various contents correspond to the relationship $$20\%\ C + 1.1\%\ Ni + \tfrac{1}{3}\%\ (Mn+Cu) = 1.5 \text{ to } 2.5$$

successively to:

a quenching after being raised to a temperature of between 800° and 1200° C., and at least one cold rolling to a ratio higher than 15%.

* * * * *